United States Patent [19]

Shimada et al.

[11] 4,050,622

[45] Sept. 27, 1977

[54] DRAWER-AND-SHELL TYPE CONTAINER WITH DRAWER STOP

[76] Inventors: Katsuji Shimada, 13-46-203, 2-chome, Nigawakita; Katsuyuki Shimada, 13-46-203, 2-chome, Nigawakita, both of Takarazuka, Hyogo, Japan

[21] Appl. No.: 719,385

[22] Filed: Aug. 31, 1976

[30] Foreign Application Priority Data

Jan. 12, 1976 Japan ..... 51-2994

[51] Int. Cl.[2] ..... B65D 5/38

[52] U.S. Cl. ..... 229/19; 229/9; 229/44 CB

[58] Field of Search ..... 229/40, 9–11, 229/20, 19, 44 CB

[56] References Cited

U.S. PATENT DOCUMENTS

| | | | |
|---|---|---|---|
| 542,903 | 7/1895 | Truax | 229/9 |
| 1,862,829 | 6/1932 | Roempler | 229/9 X |
| 2,038,454 | 4/1936 | Stevenson | 229/9 X |
| 2,163,828 | 6/1939 | Chalmers | 229/44 CB X |
| 2,475,441 | 7/1949 | Abbott | 229/19 X |
| 2,604,980 | 7/1952 | Reid | 229/9 X |
| 3,048,320 | 8/1962 | Hovland et al. | 229/20 |
| 3,933,299 | 1/1976 | Shimada et al. | 229/44 CB X |
| Re. 28,882 | 6/1976 | Mueller | 229/44 CB |

FOREIGN PATENT DOCUMENTS

| | | | |
|---|---|---|---|
| 1,034,008 | 6/1966 | United Kingdom | 229/19 |

*Primary Examiner*—Robert S. Ward, Jr.
*Attorney, Agent, or Firm*—Wenderoth, Lind & Ponack

[57] ABSTRACT

A device for preventing a push-up drawer in an outer shell from slipping out of the top or bottom of the container. The drawer has a longitudinal slit through one side thereof, and the slit is inclined at an angle with respect to the edges of the side. An angled portion is provided at the forward end of said slit. The shell is folded around said drawer, and the side of the shell, opposite the side of the drawer having the slit therethrough, has a tongue-shaped inserting piece cut therein and inserted into the longitudinal slit.

2 Claims, 5 Drawing Figures

DRAWER-AND-SHELL TYPE CONTAINER WITH DRAWER STOP

BACKGROUND AND SUMMARY OF THE INVENTION

There are several serious defects which interfere with the operation of an ordinary push-up type of container wherein a drawer-like device is contained within an outer shell. Examples of these defects are, for example, when the drawer within the outer shell is to slide upward within the shell, the lid of the container tends to open excessively wide and allow the drawer to separate or fall from the upper portion of the shell. Another example would be the instance where the drawer slips downward out of the lower part of the shell because excessive weight has been placed within the drawer.

The container of the present invention is provided with a means which will easily control the ability of the drawer to slide up or down within the shell and thereby prevent the drawer from separating and falling from the upper or lower end of the shell.

The control of the degree of opening of the lid of the container is, therefore, an important object of this invention, so that the lid will not be allowed to open more than is required when the drawer is caused to slide up by being pushed upward within the shell through this opening.

A second object of the invention is to prevent the drawer itself from slipping out of the upper part of the shell.

A third object of the invention is to prevent the drawer from accidentally slipping out of the lower end of the shell.

A fourth object of the invention is to provide a means for achieving the above objects in such a manner that there may be no discernible impairments to the appearance of the container.

A fifth object of this invention is to provide means for achieving the above objects which are both easy to construct and cheaply obtained.

BRIEF DESCRIPTION OF THE DRAWINGS

The above objects and further benefits of the present invention will become apparent when taken into consideration along with the following drawings, wherein.

DETAILED DESCRIPTION OF THE INVENTION

Figure 1A:
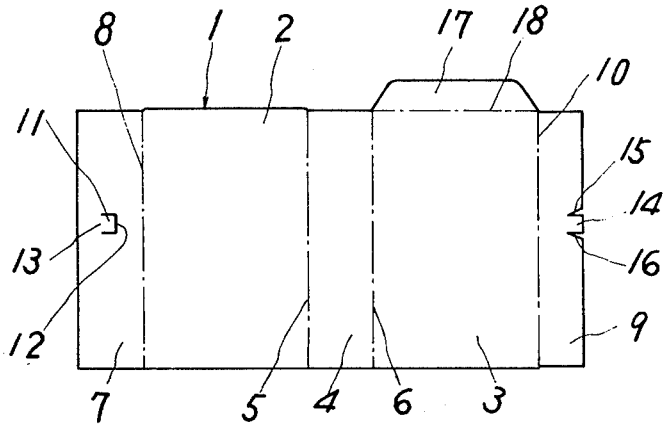
FIGS. 1*a* and 1*b* show the shell and the drawer respectively before they are assembled.
Figure 1B:
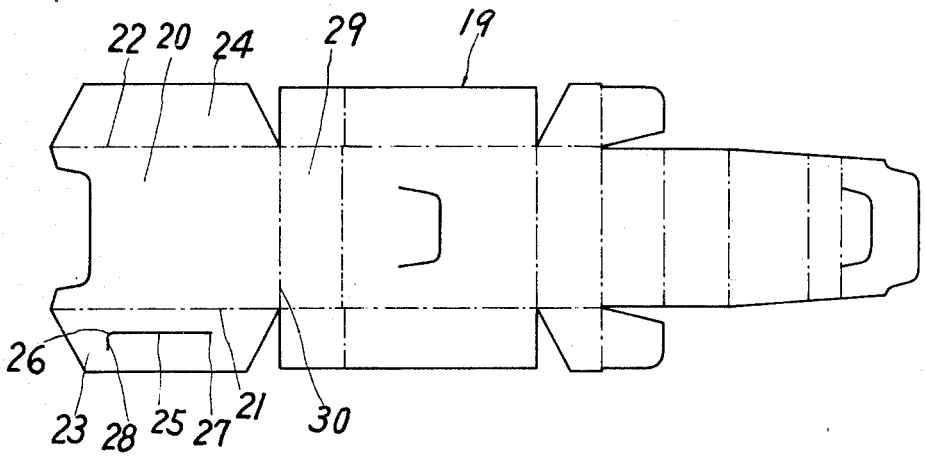

The detailed description of the present invention will now be made with reference to the drawings which show one embodiment of this invention. Though the invention is specifically directed to this one embodiment, the scope of the invention is not intended to be limited thereto.

A shell 1 has a front wall 2, a back wall 3, and a side wall 4, all of which are integrally formed along score lines 5 and 6. An additional side wall 7 is also integrally formed at one end of the front wall 2 at another score line 8. A paste flap 9 of the shell is further formed at one side of the back wall 3 by a score line 10. Slightly above the middle of the side wall 7 is a pressing piece 11 formed by a continuous U-shaped cut 12 at 13 on the side wall 7. Opposite the cut 12 is an inserting piece 14 in the form of a tongue-like appendage formed by upper and lower cuts 15 and 16 so that when the shell is folded at the scored edges and the side wall 7 is pasted to the paste flap 9, the inserting piece 14 will overlap the pressing piece 11. The inserting piece 14 is slightly larger than the pressing piece 11 in a forward direction at the edge of the paste flap 9. Finally, at the upper portion of the back wall 3 denoted by a score line 18 is a hook portion 17. By pasting the side wall 7 to the paste flap 9 at 31, the shell 1 is formed into a rectangular shell shape.

The drawer of the present invention is generally denoted by the numeral 19. A side wall 23 of the drawer is integrally formed at one side of a front wall portion 20 at a score line 21, and another side wall 24 is integrally formed at the other side of the front wall 20 at a score line 22. Through the side wall 23 a longitudinal slit 25 is formed. One end 26 of the slit is slightly inclined forward and the opposite end 27 is inclined slightly backwards. The slit 25, as a whole, is then generally a straight line which is slightly slanted. The upper end 26 of the slit has a bent portion 28 bent slightly backwards. A bottom wall 29, which is integrally formed at the lower end of the front wall 20 is delineated by a score line 30. The bottom wall 29 is designed to cooperate with any form of device for pushing up and opening the lid of the container and other parts of the drawer. These devices are not disclosed herein, as they may be any devices generally known in the art for raising the drawer within the shell.

Figure 2:
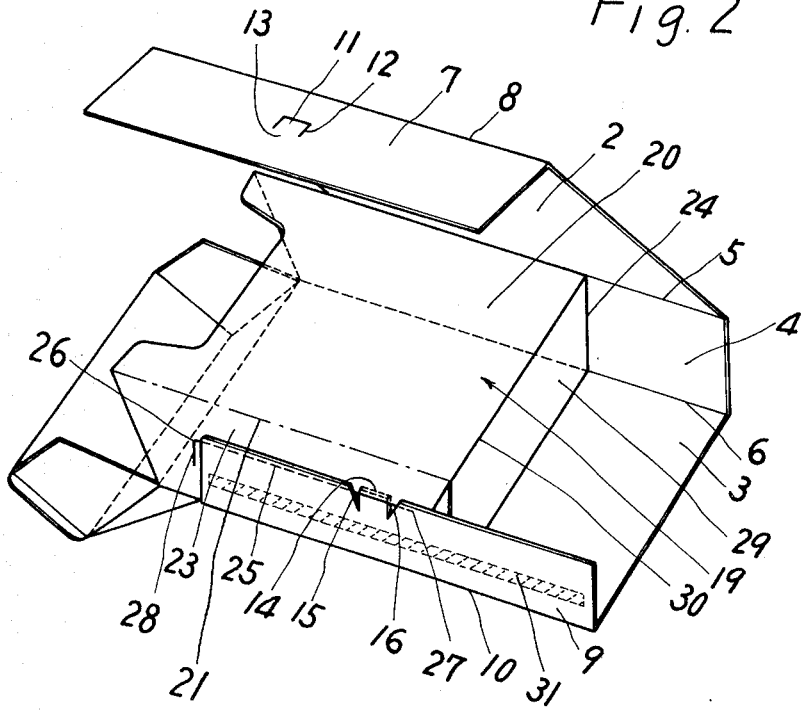
FIG. 2 is a perspective view of the container of the present invention when the lid of the container is opened.
Figure 3:
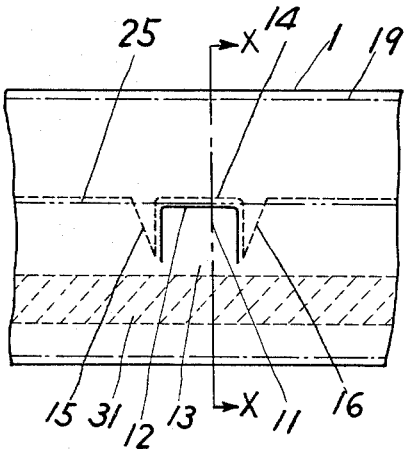
FIG. 3 is a side view of the essential parts of one side of the pushed-up drawer.
Figure 4:
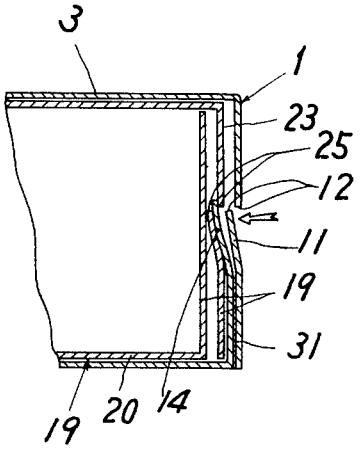
FIG. 4 is a cross-sectional view of the essential parts of the present invention taken along the line X—X of FIG. 3.

When the drawer 19, along with the raising device for pushing up and opening the lid of the container, is inserted into the shell 1, an apparatus as shown in FIG. 2 is produced. The side wall 7 of the shell is folded over the side wall 23 of the drawer 19 in such a manner that the pressing piece 11 is placed upon the inserting piece 14 (which is slightly larger than the pressing piece 11), and the edge of the inserting piece 14 is placed upon the upper end 26 of the longitudinal slit 25. The pressing piece 11 is then pressed inward against the inserting piece 14, and the inserting piece 14 is forceably inserted into the longitudinal slit 25. Once the inserting piece 14 is forceably inserted into the slit 25 by the pressing piece 11, it will not come out of the longitudinal slit.

When the drawer 19 is caused to slide upward within the shell 1 so that the lid may be opened, the inserting piece 14 which has previously been inserted into the longitudinal slit 25, will move toward the lower portion of the longitudinal slit 25 in relation to the sliding movement of the drawer. When the inserting piece 14 reaches the lower end 27 of the longitudinal slit 25, the resistance of the inserting piece will not allow the drawer 19 to slide any further. This combination not only limits the degree to which the lid will open, but also prevents the drawer 19 from separating or falling from the upper side of the shell 1.

When the drawer 19 slides downward within the shell 1 (in order to close the lid), the inserting piece 14 moves toward the upper end of the longitudinal slit 25 relative to the sliding of the drawer 19. Once the inserting piece 14 reaches the upper end 26 of the longitudinal slit 25, the entire drawer 19 is completely contained within the shell 1. Even if the edge of the inserting piece 14 is only slightly positioned within the longitudinal slit 25, there is no possibility that the inserting piece 14 will disengage the longitudinal slit 25. This phenomenon results because the edge of the inserting piece 14 will go deeply into the bent portion 28 of the upper end of the slit 26. Therefore, the drawer 19 will not slide further downward within the shell, and the drawer 19 will be prevented from separating or falling from the lower end of the shell 1.

What is claimed is:

1. A device for preventing a push-up drawer in an outer container from slipping out of the top or bottom of the container, said device comprising:

a drawer having a longitudinal slit through one side thereof, said slit being inclined at an angle with respect to the edges of said side and having an angled portion at the forward end of said slit; and a shell folded around said drawer, the side of said shell, opposite the side of said drawer having said slit therethrough, having a tongue-shaped inserting piece cut therein and inserted into said longitudinal slit.

2. A device for preventing a push-up drawer in an outer container from slipping out of the top or bottom of the container, said device comprising:

a drawer having a longitudinal slit through one side thereof, said slit being inclined at an angle with respect to the edges of said side and having an angled portion at the forward end of said slit; and a shell folded around said drawer, the ends of said shell overlapping and affixed to each other at the side of said drawer containing said longitudinal slit therein, said end which is underlapped against said drawer having a tongue-shaped inserting piece cut therein opposite said slit, said inserting piece being inserted into said slit, and said overlapped end having a pressing piece cut therefrom opposite said inserting piece for pressing said inserting piece into said longitudinal slit.

* * * * *